US006134938A

United States Patent [19]

Ohtsuka

[11] Patent Number: 6,134,938

[45] Date of Patent: Oct. 24, 2000

[54] FORMING TOOLS

[75] Inventor: Yasuyuki Ohtsuka, Kanagawa, Japan

[73] Assignee: Amada Metrecs Company, Limited, Kanagawa, Japan

[21] Appl. No.: 09/353,772

[22] Filed: Jul. 15, 1999

[30] Foreign Application Priority Data

Jul. 16, 1998 [JP] Japan ..... 10-202149

[51] Int. Cl.[7] ..... B21D 37/02

[52] U.S. Cl. ..... 72/328; 72/344; 72/446; 72/470; 72/427; 83/698.91; 83/571

[58] Field of Search ..... 72/328, 344, 446, 72/470, 427, 481.1, 482.91; 83/123, 129, 109, 549, 552, 571, 698.91, 685

[56] References Cited

U.S. PATENT DOCUMENTS

| | | | |
|---|---|---|---|
| 3,269,168 | 8/1966 | Anderson | 72/412 |
| 3,673,908 | 7/1972 | Smith | 72/470 |
| 3,908,500 | 9/1975 | Gargrave | 83/563 |
| 4,611,483 | 9/1986 | Hadaway | 72/427 |
| 4,985,983 | 1/1991 | Otto | 72/446 |
| 5,195,413 | 3/1993 | Johnson | 83/552 |
| 5,451,195 | 9/1995 | Fujiwara | 72/446 |

FOREIGN PATENT DOCUMENTS

| | | | |
|---|---|---|---|
| 1194227 | 6/1965 | Germany | 72/446 |
| 62-234622 | 10/1987 | Japan | 72/328 |

*Primary Examiner*—Daniel C. Crane
*Attorney, Agent, or Firm*—Blank Rome Comisky & McCauley LLP

[57] ABSTRACT

Forming tools includes an upper holder; a lower holder; a punch having a punch body which can be attached to/detached from the upper holder and the lower holder; an ejector being disposed movably in a vertical direction around a convex portion provided on a face of the punch body; a resilient unit for urging the ejector, the resilient unit being provided on a back face of the punch body; a die having a die body which can be attached to/detached from the upper holder and the lower holder, the die body being provided with a concave portion for performing forming work on a workpiece in cooperation with the convex portion; another ejector for pushing out a forming-worked portion of the workpiece from the concave portion, the another ejector being provided movably in a vertical direction within the die body; and another resilient unit for urging the another ejector, the another resilient unit being provided on the die body. Especially, the resilient unit in the punch and the resilient unit in the die has the same structure.

3 Claims, 3 Drawing Sheets

FORMING TOOLS

BACKGROUND OF THE INVENTION

1. Field of the Invention

The present invention relates to forming tools for performing forming work on a sheet workpiece, and in particular to forming tools where a punch and a die are made common in their structural components and the punch and the die can alternately be detachably exchanged to an upper holder and a lower holder, and which are detachably exchangeable to such a conventional punch press as a turret punch press like conventional tools.

2. Description of the Related Art

As a conventional example relating to the present invention, there is, for example, Japanese Patent Application Laid-Open No. 62-234622. The above conventional example is configured such that a punch and a die are detachably exchangeable to an upper holder and a lower holder alternately.

In the conventional example, since the punch and the die have structures completely different from each other and they have no common structural part or portion, the punch and the die must be manufactured fully independently from each other, and they have expensive structures (which results in increase in manufacturing cost). Also, fixing of the punch or the die to the upper holder is performed by a plurality of fixing screws, and the fixing screws project from an outer peripheral face of the upper holder. Therefore, there is a problem that, when the upper holder is mounted on an upper tool supporting member movably in a vertical direction, the fixing screws are obstructive so that the entire structure of the punch press is large-sized in a vertical direction.

SUMMARY OF THE INVENTION

The present invention has been achieved with such points in mind.

It therefore is an object of the present invention to provide forming tools where a punch and a die are made common in their structural components and the punch and the die can alternately be detachably exchanged to an upper holder and a lower holder.

It is another object of the present invention to provide forming tools which are detachably exchangeable to such a conventional punch press as a turret punch press like conventional tools.

To achieve the object, according to a first aspect of the present invention, there is provided forming tools comprising: an upper holder; a lower holder; a punch having a punch body which can be attached to/detached from the upper holder and the lower holder; an ejector being disposed movably in a vertical direction around a convex portion provided on a face of the punch body; a resilient unit for urging the ejector, the resilient unit being provided on a back face of the punch body; a die having a die body which can be attached to/detached from the upper holder and the lower holder, the die body being provided with a concave portion for performing forming work on a workpiece in cooperation with the convex portion; another ejector for pushing out a forming-worked portion of the workpiece from the concave portion, the another ejector being provided movably in a vertical direction within the die body; and another resilient unit for urging the another ejector, the another resilient unit being provided on the die body, wherein the resilient unit in the punch and the resilient unit in the die has the same structure.

Accordingly, the resilient units in the punch and the die can be made common and they can be manufactured more inexpensively. In addition thereto, forming tools for performing on a workpiece forming work for forming a upwardly projecting portion and a downwardly projecting portion can be provided inexpensively.

According to a second aspect of the present invention, as it depends from the first aspect, there is provided forming tools wherein the upper holder is formed in a cylindrical shape having a punch head at an upper portion; and wherein the upper holder is provided with an engaging device for detachably engaging the punch body or the die body in a recessed manner from an outer peripheral face of the upper holder.

According to the above configuration, for example, when the upper holder is mounted movably in a vertical direction in a mounting hole of an upper turret in a turret punch press, the engaging device is not obstructive. Also, the engaging device can be mounted on a lower portion of the upper holder, so that a vertical size of the entire structure of the upper forming tool according to the present invention can be made equal to that of a conventional upper forming tool.

According to a third aspect of the present invention, as it depends from the first aspect or the second aspect, there is provided forming tools wherein the engaging device is provided with a locking mechanism for maintaining the punch body or the die body in an engaging state.

Accordingly, the punch body or the die body is prevented from coming off due to vibrations or the like generated during forming work, and fixing of the punch body or the die body can more securely be performed.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
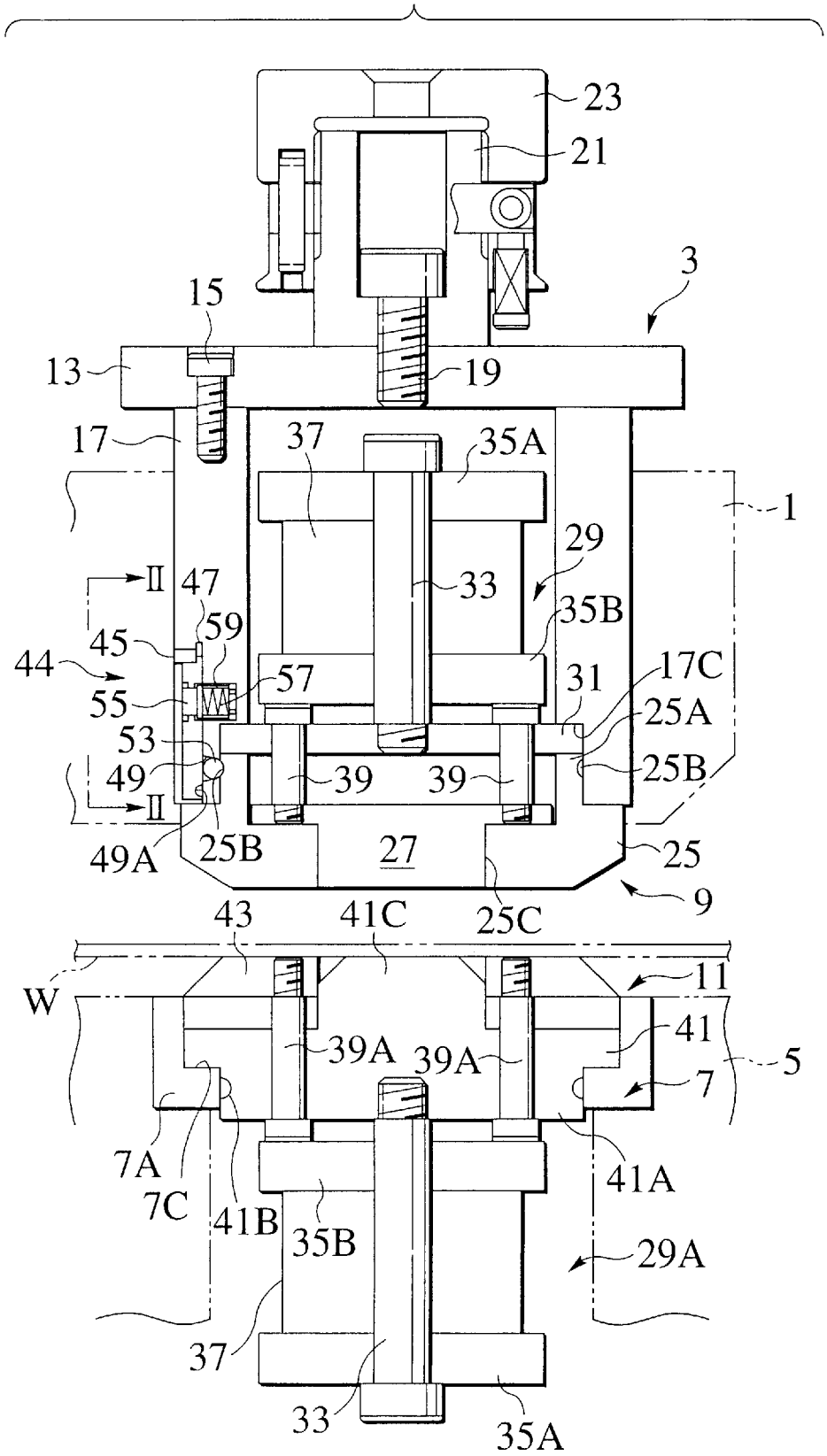
FIG. 1 is a sectional explanation view of forming tools according to an embodiment of the present invention.
Figure 2:
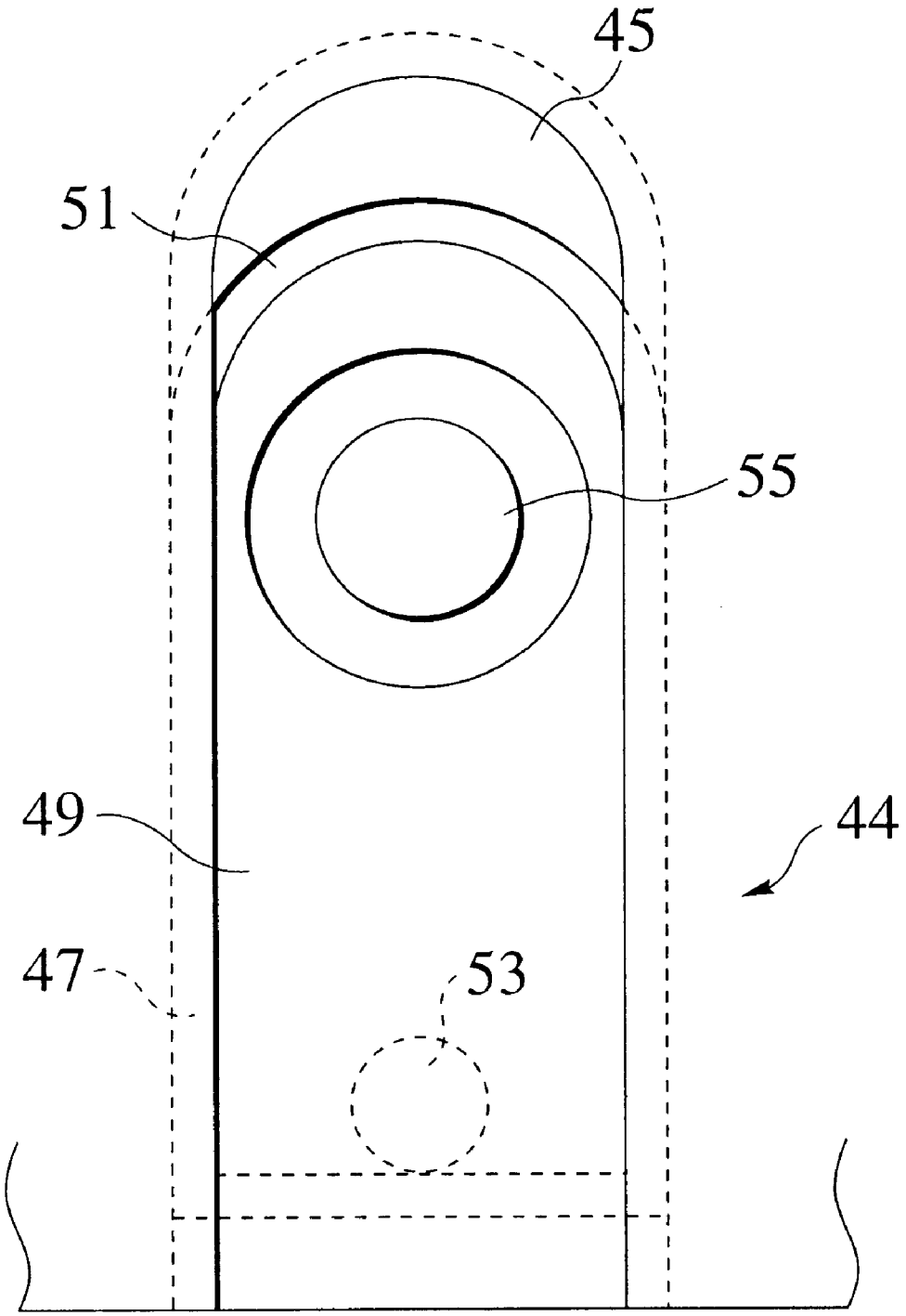
FIG. 2 is an explanation view viewed from arrow line II—II in FIG. 1.

There will be detailed below the preferred embodiments of the present invention with reference to the accompanying drawings. Like members are designated by like reference characters.

Referring to FIG. 1, forming tools according to an embodiment of the present invention comprises an upper holder 3 supported detachably and movably in a vertical direction by an upper tool supporting member 1 (which corresponds to an upper turret in a case of a turret punch press) in a punch press such as a turret punch press or the like, and a lower holder 7 supported detachably by a lower tool supporting member 5 of the punch press. A die 9 is detachably attached to or mounted on the upper holder 3, while a punch 11 is detachably mounted on the lower holder 7.

The upper holder 3 is provided with a head plate 13, and a cylindrical body 17 is mounted integrally on a lower face of the head plate 13 by a plurality of bolts 15. A cylindrical recess 17C in which a punch 11 or a die 9 is fitted is formed in the cylindrical body 17. The cylindrical body 17 can be manufactured inexpensively, for example, by cutting a pipe material. A head strut 21 is integrally mounted on a central portion of the head plate 13 by a bolt 19, and a head nut 23 is screwed on the head strut 21 adjustably in a vertical direction. Such a structure that the head nut 23 is adjusted to the head strut 21 in a vertical direction is well known as disclosed, for example, in Japanese Patent No. 2543293 and detailed explanation thereof will be omitted. The lower holder 7 is formed in a cylindrical shape and it is provided at its lower portion with a tool supporting portion 7A. A cylindrical recess 7C in which the punch 11 or the die 9 is fitted is formed in the lower holder 7.

The die 9 is provided with a die body 25 which is detachably exchangeable to a lower portion of the cylindrical body 17 in the upper holder 3 and the lower holder 7. The die body 25 is formed in a circular shape where it has a slightly smaller diameter than an outer diameter of the cylindrical body 17, and it is provided with a small diameter cylindrical portion 25A which can be fitted into the cylindrical body 17. A peripheral groove 25B is formed on an outer peripheral face of the small diameter cylindrical portion 25A. Key grooves (not shown) extending in a vertical direction and engagable with positioning keys (not shown) provided at a lower portion of the cylindrical body 17 are formed at an appropriate number of portions on an outer peripheral face of the die body 25.

A concave portion 25C for performing forming work on a sheet workpiece W is formed on the die body 25. An ejector 27 for pushing out the workpiece W from the concave portion 25C is disposed in the convex portion 25C movably in a vertical direction. A resilient unit 29 for urging the ejector 27 in a direction of pushing-out the workpiece W is mounted on the die body 25.

Particularly, a supporting bolt 33 is screwed in a standing manner at a central portion of a mounting plate 31 integrally mounted on a back face of the die body 25 by bolts or the like, and a proper elastic member 37 serving as a stopper spring is interposed between upper and lower spring seat plates 35A and 35B supported movably in a vertical direction by the supporting bolt 33. A plurality of pin members 39 which pass through the mounting plate 31 movably in a vertical direction and whose heads abut on the spring seat plate 35B, each pin member 39 serving as an urging force transmitting member, are coupled to the ejector 27.

The punch 11 is provided with a punch body 41 which is detachably attached to the cylindrical body 17 of the upper holder 3 and the lower holder 7. The outer diameter of the punch body 41 is formed equally to the outer diameter of the die body 25 and the diameter of a small diameter portion 41A formed on a back face of the punch body 41 is formed equally to the outer diameter of the small diameter cylindrical portion 25A of the die body 25. A peripheral groove 41B corresponding to the peripheral groove 25B of the small diameter cylindrical portion 25A is formed on an outer peripheral face of a small diameter portion 41A of the punch body 41. Furthermore, a convex portion 41C for performing forming work on the workpiece W in cooperation with the concave portion 25C is provided in a projecting manner on a front face of the punch body 41. Key grooves (not shown) extending in a vertical direction are provided at an appropriate number of portions on the outer peripheral face of the punch body 41 like the die body 25.

An annular ejector 43 surrounding the convex portion 41C is provided movably in a vertical direction on a front face side of the punch body 41, and a resilient unit 29A having the same configuration as the resilient unit 29 is mounted on a back face of the punch body 25. Component parts or portions of the resilient unit 29A having the same functions as those of the resilient unit 29 are denoted by the same reference numerals and explanation thereof will be omitted. Reference numeral 39A denotes a pin member corresponding to the pin member 39.

In order to detachably and exchangeably mount the die body 25 of the die 9 and the punch body 41 of the punch 11 to the cylindrical body 17 of the upper holder 3, engaging devices 44 are provided at a plurality of portions on a lower and outer peripheral face of the cylindrical body 17.

That is, guide grooves 45 each extending in a vertical direction and opened downwardly are formed at a plurality of portions on a lower portion of an outer peripheral face of the cylindrical body 17, and an engaging groove 47 having a width larger than that of each guide groove 45 is formed at a bottom portion of the guide groove 45. A flange-shaped projecting portion 51 engaged with the engaging groove 47 is formed on a proper peripheral face of a slide piece 49 engaged with the guide groove 45 movably in a vertical direction. The slide piece 49 is provided on the cylindrical body 17 in a state where it is recessed from an outer peripheral face of the cylindrical body 17, and it is engaged with the guide groove 45 only movably in a vertical direction.

In order to fix the die 9 and the punch 11 to the cylindrical body 17, such an engaging piece 53 as a ball which projects in an inner peripheral face of the cylindrical body 17 to be engagable with the peripheral grooves 25B and 41B of the die 9 and the punch 11 is provided movably within a radially tapered hole formed on the cylindrical body 17.

In order to move the engaging piece 53 within the tapered hole in outer and inner directions, a concave or recessed portion 49A for allowing the engaging piece 53 to move outward is formed on a proper position (a lower portion in this embodiment) of the slide piece 49. Also, a push bottom 55 is provided on a suitable portion of the slide piece 49 as a locking mechanism for locking the slide piece 49, and a cylindrical locking piece 59 urged in an outer direction by a spring 57 is provided on the cylindrical body 17 such that it abuts on the push bottom 55 and can enter in the slide piece 49 slightly.

In the configuration as the above, as shown in FIG. 1, in a state where the die 9 is mounted on the upper holder 3 and the punch 11 is mounted on the lower holder 7, when the head nut 23 is pressed downwardly by a striker in the punch press after a workpiece W is placed and positioned on the punch 11, the upper holder 3 is lowered relative to the upper tool supporting member 1 against a lifter spring (not shown) so that the work piece W is sandwiched between the ejector 43 of the punch 11 and the lower face of the die body 25 of the die 9.

Thereafter, when the upper holder 3 is further lowered, the ejector 27 is ascended relatively against the elastic member 37 of the resilient unit 29 by the convex portion 41C of the punch body 41 and the ejector 11 is descended against the elastic member 37 of the resilient unit 29A by the die body 25, so that an upwardly projecting portion is formed on the workpiece W.

Figure 3:
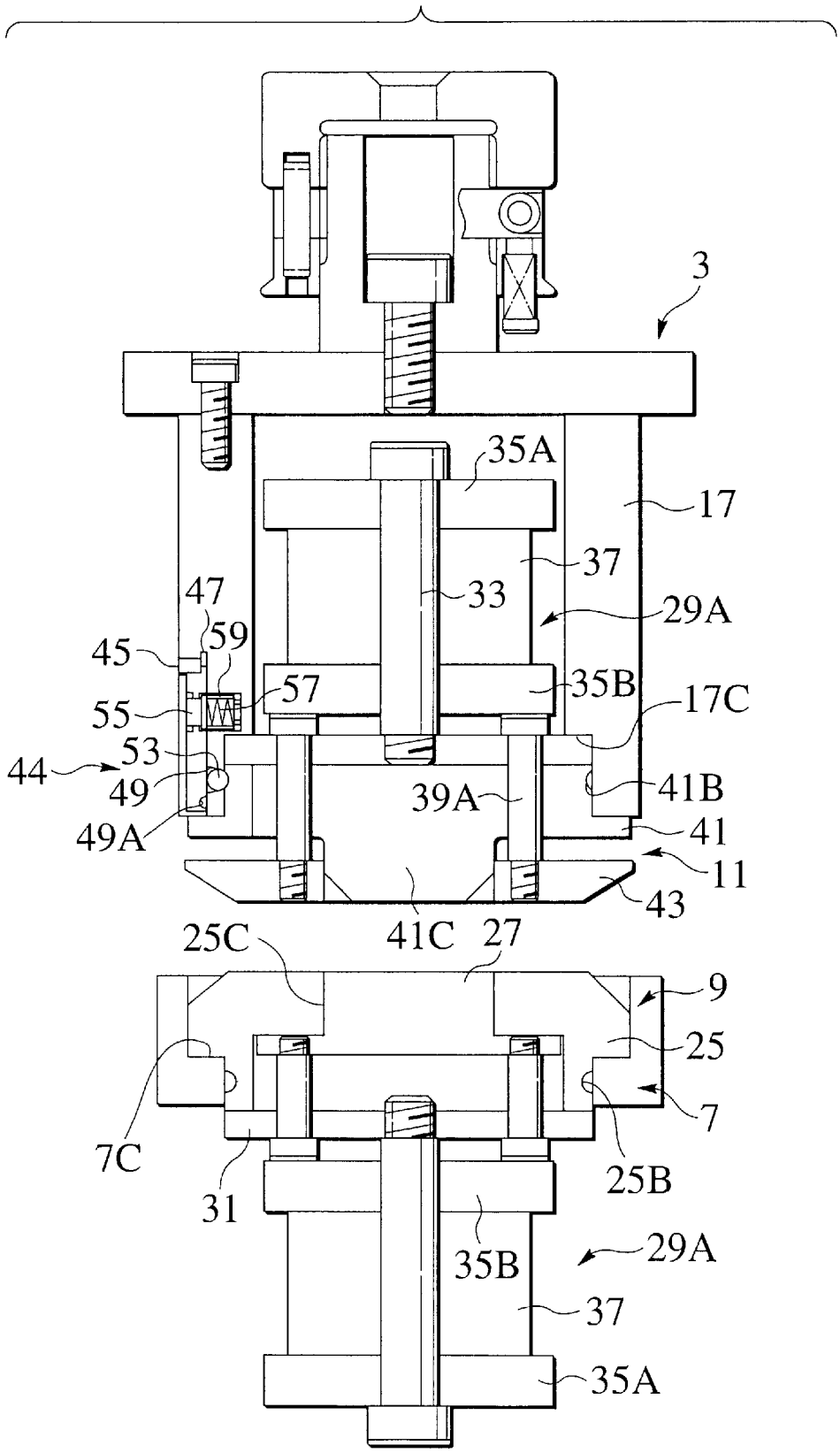
FIG. 3 is an explanation view showing a state where a punch and a die have been detached from and exchanged to be attached to an upper holder and a lower holder from a state shown in FIG. 1.

As shown in FIG. 3, forming-work of a downwardly projecting portion on the workpiece W can easily be performed by exchanging the punch 11 and the die 9 to the upper holder 3 and the lower holder 7 in a detaching and attaching manner.

Detaching of the die 9 from the upper holder 3 is performed in the following manner. After the upper holder 3 is detached from the upper tool supporting member 1, the push bottoms 55 respectively provided on the slide pieces 49 disposed on the plurality portions are pushed so that the locking pieces 59 are pushed in against the springs 57 and slight insertions of the locking pieces 59 into the slide pieces 49 are cancelled. Thereafter, the slide pieces 49 are moved upward and the recessed portions 49A of the slide pieces 49 are caused to correspond to the engaging pieces 53. Then, the die 9 can easily be detached from the upper holder 3 by drawing out the die 9 downward to the upper holder 3.

Since the punch 11 is supported only by the lower holder 7, it can be detached from the lower holder 7 by lifting up the punch 11 relative to the lower holder 7. As described above, when the slide pieces 49 provided at the plurality of portions are lowered after the punch 11 which has been detached from the lower holder 7 is fitted in the cylindrical body 17 in the upper holder 3 and positioned thereto, the slide pieces 49 provided at the plurality of portions are lowered, the engaging pieces 53 are moved in an inner direction and they are engaged with the peripheral groove 41B of the punch 11. Also, the locking pieces 59 are pushed by the springs 57 to move the push bottoms 55 in an outer direction, and they enter in the locking pieces 59 slightly, thereby locking the slide pieces 49 such that the slide pieces 49 are prevented from moving in a vertical direction. The direction of the die 9 is matched with that of the punch 11 mounted on the upper holder 3 and it is mounted or attached to the lower holder 7.

As is apparent from the above explanation, in this embodiment, since the die 9 and the punch 11 are detachably and exchangeably used to the upper holder 3 and the lower holder 7, forming work for an upwardly projecting portion and forming work for a downwardly projecting portion can easily be performed on a workpiece W by a simple configuration.

Since the resilient units having the same configuration are employed in the die 9 and the punch 11, portions of the structural parts or portions for the die 9 and the punch 11 can be made common, so that the die 9 and the punch 11 can be manufactured inexpensively.

Also, since the slide piece 49 of the engaging device in the upper holder 3 is disposed on the cylindrical body 17 of the upper holder 3 so as to be recessed from an outer peripheral face of the cylindrical body 17, it is not obstructive when the upper holder 13 is mounted in the mounting hole of the upper turret in the turret punch press. Thereby, the engaging device can be provided on a lower portion of the cylindrical body 17, so that a vertical size of the entire structure or configuration can be suppressed to be equal to a height of a conventional upper tool.

Furthermore, since the slide piece 49 of the engaging device is structured such that it can be locked so as not to be moved in a vertical direction, fixation of the die 9, the punch 11 and the like to the upper holder 3 can securely be performed.

The entire contents of Japanese Patent Application P10-202149 (filed Jul. 16, 1998) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. Forming tools, comprising:

an upper holder;

a lower holder;

a punch having a punch body which can be attached to/detached from the upper holder and the lower holder;

an ejector being disposed movably in a vertical direction around a convex portion provided on a face of the punch body;

a resilient unit for urging the ejector, the resilient unit being provided on a back face of the punch body;

a die having a die body which can be attached to/detached from the upper holder and the lower holder, the die body being provided with a concave portion for performing forming work on a workpiece in cooperation with the convex portion;

another ejector for pushing out a forming-worked portion of the workpiece from the concave portion, the another ejector being provided movably in a vertical direction within the die body; and another resilient unit for urging the another ejector, the another resilient unit being provided on the die body, wherein the resilient unit in the punch and the resilient unit in the die has the same structure.

2. Forming tools according to claim 1, wherein the upper holder is formed in a cylindrical shape having a punch head at an upper portion; and wherein the upper holder is provided with an engaging device for detachably engaging the punch body or the die body in a recessed manner from an outer peripheral face of the upper holder.

3. Forming tools according to claim 2, wherein the engaging device is provided with a locking mechanism for maintaining the punch body or the die body in an engaging state.

* * * * *